US005291259A

United States Patent [19]

Weitzel et al.

[11] Patent Number: 5,291,259

[45] Date of Patent: Mar. 1, 1994

[54] IMAGE FORMING APPARATUS HAVING TONER CLEANING DEVICE

[75] Inventors: Richard A. Weitzel, Hilton; Thomas K. Hilbert, Spencerport; Bruce J. Rubin, Rochester, all of N.Y.

[73] Assignee: Eastman Kodak Company, Rochester, N.Y.

[21] Appl. No.: 975,449

[22] Filed: Nov. 12, 1992

[51] Int. Cl.[5] ..... G03G 21/00

[52] U.S. Cl. ..... 355/306; 15/256.52; 355/305

[58] Field of Search ..... 355/270, 269, 305, 306, 355/296, 301-303; 118/652; 346/762, 108, 160; 15/256.5, 256.51, 256.52

[56] References Cited

U.S. PATENT DOCUMENTS

| | | | |
|---|---|---|---|
| 3,580,673 | 5/1971 | Yang | 355/306 |
| 4,006,987 | 2/1977 | Tomono et al. | 355/298 |
| 4,110,034 | 8/1978 | Suzuki | 355/305 |
| 4,279,499 | 7/1981 | Rezanka et al. | 355/305 |
| 4,439,034 | 3/1984 | Daniels | 118/652 X |
| 4,502,780 | 3/1985 | Suzuki et al. | 355/305 |
| 4,515,467 | 5/1985 | Suzuki | 355/305 |
| 4,545,325 | 10/1985 | Komatsu et al. | 118/652 X |
| 4,546,060 | 10/1985 | Miskinis et al. | 430/108 |
| 4,638,759 | 1/1987 | Ville et al. | 118/657 |
| 4,734,741 | 3/1988 | Hanner | 355/298 |
| 4,797,704 | 1/1989 | Hill et al. | 355/260 |
| 5,083,166 | 1/1992 | Hill et al. | 355/260 |
| 5,138,388 | 8/1992 | Kamp et al. | 118/652 X |
| 5,148,220 | 9/1992 | Hilbert et al. | 355/245 |
| 5,164,742 | 11/1992 | Baek et al. | 346/76 L |

FOREIGN PATENT DOCUMENTS

| | | | |
|---|---|---|---|
| 0257478 | 12/1985 | Japan | 355/305 |
| 91/08815 | 11/2691 | PCT Int'l Appl. . | |

OTHER PUBLICATIONS

U.S. Patent Application Serial No. 07/763,509, filed Nov. 30, 1990, of DeBoer et al.

*Primary Examiner*—A. T. Grimley
*Assistant Examiner*—Robert Beatty
*Attorney, Agent, or Firm*—Leonard W. Treash, Jr.

[57] ABSTRACT

Image forming apparatus includes a toner cleaning device for cleaning toner off an image surface. The cleaning device includes a cleaning applicator for moving magnetic particulate cleaning material past the surface to be cleaned. Particulate material is moved from a sump to the cleaning applicator by a transport positioned between them. A detoning roller is positioned to attract toner from particulate material associated with the transport. When the cleaning device is not cleaning, it has a mode of operation in which the transport and the detoning roller continue to operate to continue to detone particulate material which moves from the sump around the transport and back to the sump.

5 Claims, 10 Drawing Sheets

10
7
281
81
8
282
82
47
46
40
41
42
245
246
243
244
242
252
253
247
248

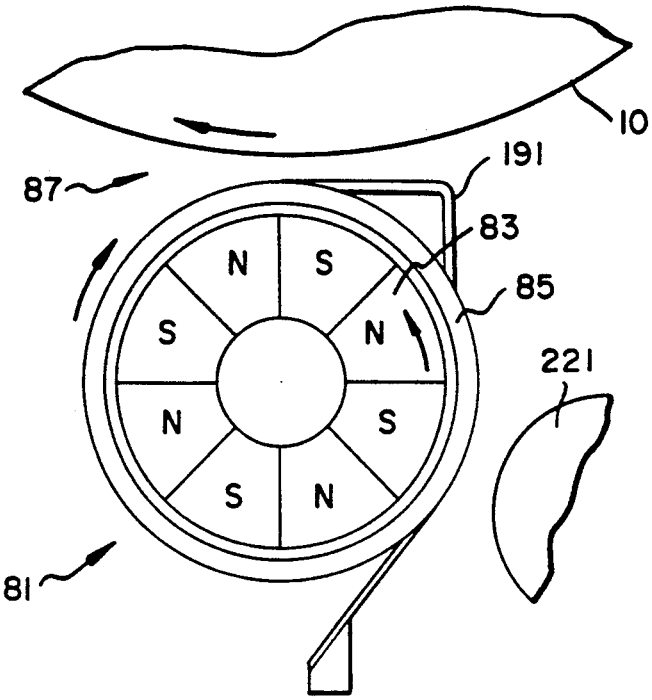
FIG. 9
FIG. 10
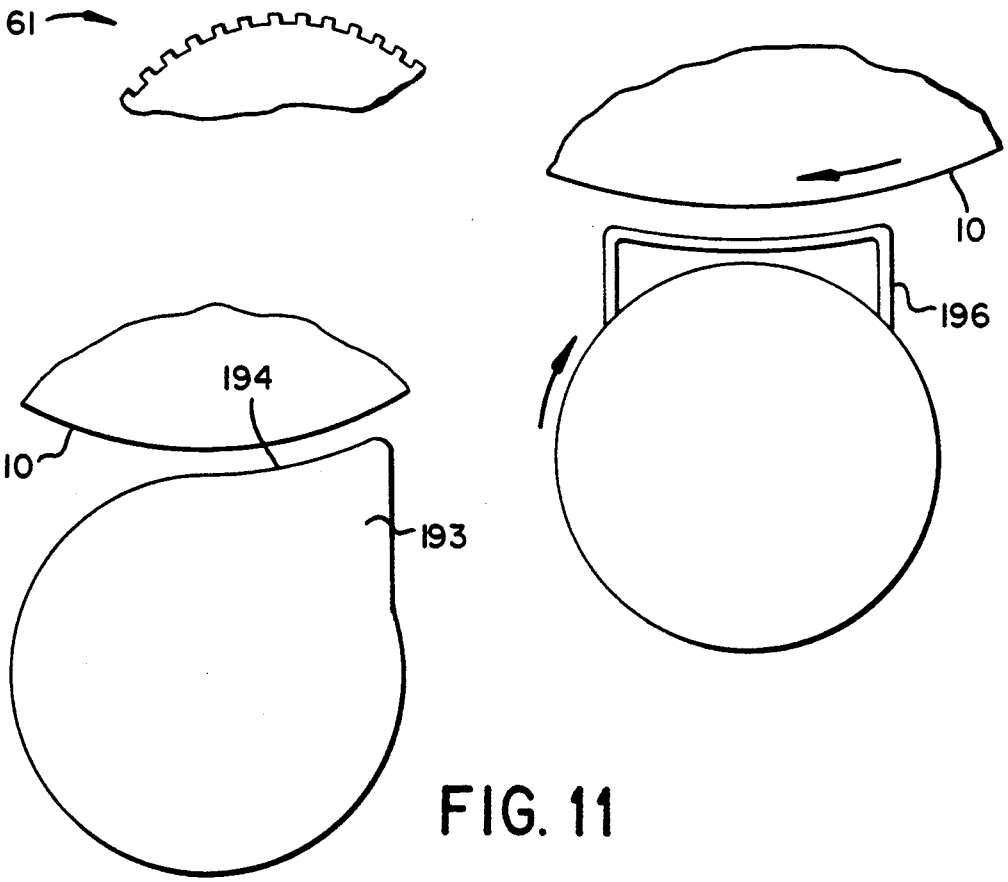
FIG. 11

IMAGE FORMING APPARATUS HAVING TONER CLEANING DEVICE

CROSS REFERENCE TO RELATED APPLICATIONS

This application relates to cofiled U.S. patent application Ser. No. 07/973,802, filed Nov. 12, 1992 of Hilbert et al, U.S. patent application Ser. No. 07/973,803, filed Nov. 12, 1992 of Kamp et al and U.S. patent application Ser. No. 07/975,258, filed Nov. 12, 1992 of Yousey et al..

BACKGROUND OF THE INVENTION

This invention relates to a device for cleaning toner from a moving surface. Although not limited thereto, it is particularly usable in image forming apparatus in which a uniform layer of toner is applied to a surface, the toner is imagewise tacked to the surface, and untacked toner is cleaned off the surface. It can also be used in conventional image forming apparatus.

U.S. patent application Ser. Nos. 07/632,698, now U.S. Pat. No. 5,138,388 (Kamp et al); 07/673,509 (DeBoer et al) now U.S. Pat. No. 5,227,265; 07/621,691, now abandoned (DeBoer et al); and PCT application No. 91/08815, filed Nov. 26, 1991 disclose a process in which a uniform layer of toner is applied to a surface. The toner is imagewise tacked, preferably with a laser, to the surface and then the untacked toner is cleaned off the surface, leaving a toner image corresponding to the tacked toner. The tacked toner image can then be transferred to another surface, or it can be fixed to the surface to which it is tacked. This process can provide extremely high resolution and high density with fine toner particles and a precise laser. It does not require the use of light sensitive materials.

In this process, tacking can be accomplished by softening a heat softenable layer on the image surface, softening a toner particle where it touches the image surface, or both. Toner can be applied by a device comparable to that conventionally used to develop electrostatic images, for example, a magnetic brush development station. However, cleaning is somewhat more difficult, since the loose toner must be cleaned off without disturbing what may be quite lightly tacked imagewise toner. A preferable approach to this cleaning problem is to use a magnetic brush cleaner employing hard magnetic carrier particles and a rotating magnetic core which provides a relatively soft cleaning brush that will clean off the loose toner while leaving the lightly tacked toner image.

U.S. Pat. Nos. 4,734,741; 3,580,673; 4,006,987; 4,110,034 and 4,515,467 are representative of typical magnetic brush cleaners in which a nonmagnetic sleeve is rotated around a stationary core to move cleaning particles attractive to toner past a surface to be cleaned. The cleaning particles are essentially the same as carrier particles used in magnetic brush cleaners. Toner is removed from the cleaning particles by contacting them with a detoning roller which is electrically biased to attract the toner. Toner is scraped off the detoning roller with a blade and falls into a sump for transport by an auger to a toner collection bottle. U.S. Pat. No. 4,279,499 shows a magnetic brush cleaning device having a sump for cleaning particles.

Cleaning of toner off a surface using cleaning particles is dependent upon the amount of toner already on the cleaning particles. Thus, a generic problem with such cleaning devices involves the effectiveness of a continuous detoning operation. This problem is particularly severe in appartus in which large amounts of toner must be cleaned. Thus, the previously described process in which all toner is cleaned off except that tacked, requires much greater detoning than does conventional electrostatic imaging processes.

U.S. Pat. No. 5,148,280; issued Sep. 15, 1992, Hilbert et al, shows a color electrophotographic image forming apparatus in which two color development stations are constructed as a single unit and spring urged toward a photoconductive drum. Toner applying applicators are maintained at a critical spacing whether applying toner or not. A magnetic valving structure is used to turn the stations on and off without changing their position with respect to the drum.

SUMMARY OF THE INVENTION

It is an object of the invention to provide a cleaning device of the type using particulate cleaning material in which detoning of the particulate material is improved.

These and other objects are accomplished by an image forming apparatus including means for moving particulate cleaning material alternatively through first and second paths. The first path moves the particulate cleaning material away from a sump, through a cleaning position where it passes through cleaning relation with a surface to be cleaned and then back to the sump. The second path moves the material away from the sump and back to the sump without passing through the cleaning position. A detoning means is positioned in detoning relation with the particulate cleaning material in the second path.

According to a preferred embodiment, the detoning means is a detoning roller positioned adjacent a transport means positioned between the sump and a cleaning element. The cleaning element can be turned on or off. When the cleaning element is turned off, the particulate material will not clean, but the transport can be left on allowing detoning to continue. Thus, the first and second paths preferably have common portions and the detoning roller is adjacent the common portion.

This structure is particularly usable in image forming apparatus in which cleaning is only performed for a portion of the operative cycle of the apparatus. Detoning can continue though the cleaning station is off, further reducing the concentration of toner in the particulate cleaning material and increasing the effectiveness of the cleaning.

It is particularly useful in image forming apparatus of the type described above having a toner applying cycle and a toner tacking cycle in which toner is imagewise tacked to an image surface. Detoning can be carried out throughout the toner applying and tacking cycles, improving the cleaning effectiveness during the cleaning cycle.

BRIEF DESCRIPTION OF THE DRAWINGS

FIGS. 9–13 are front schematics of an alternative shell designs for cleaning stations usable in the apparatus shown in FIG. 1.

DESCRIPTION OF THE PREFERRED EMBODIMENTS

Figure 1:
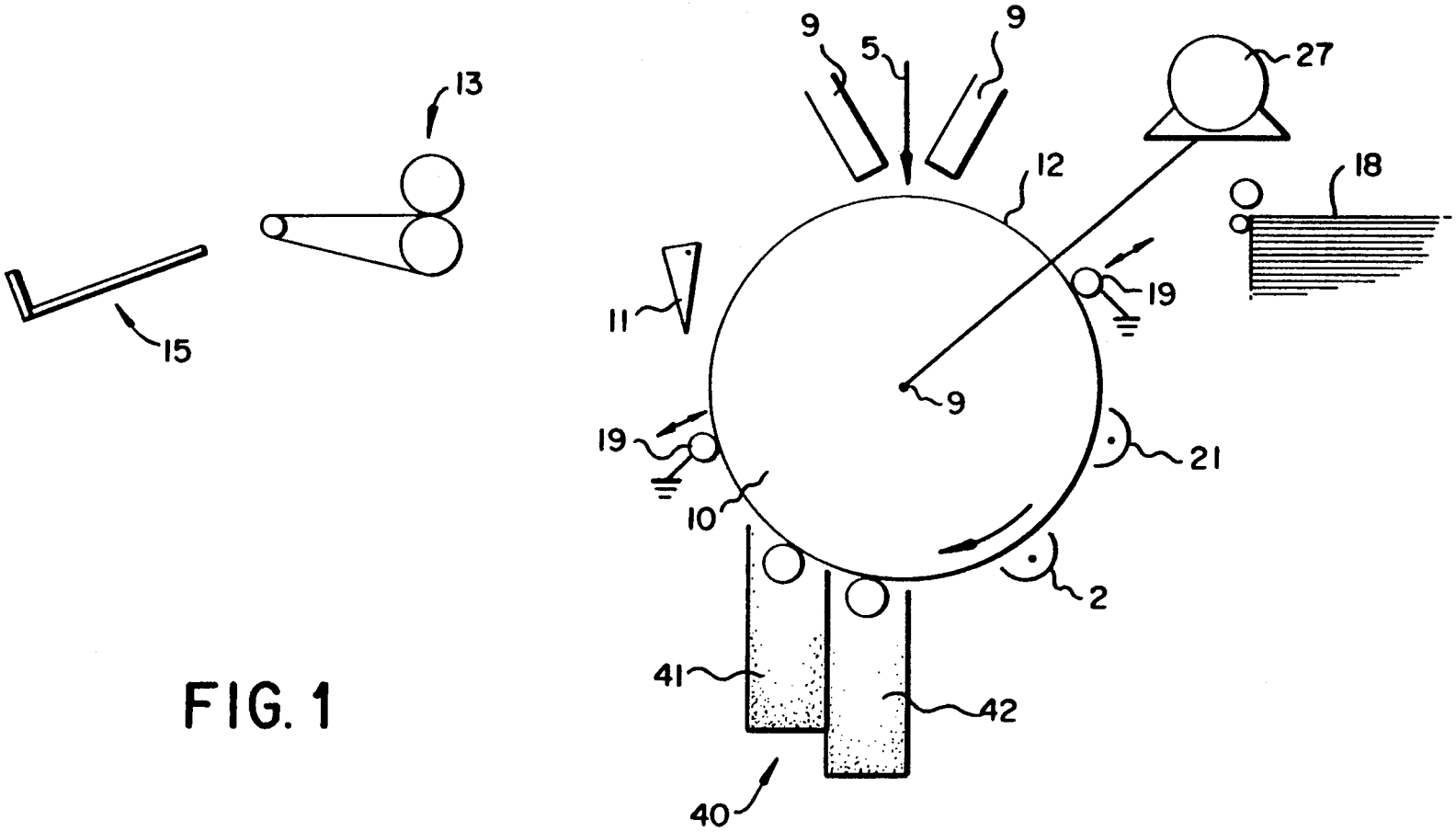
FIG. 1 is a front schematic of an image forming apparatus.

According to FIG. 1, a drum 10 is rotated by a motor 27 about an axis of rotation 9 to bring its peripheral surface 12 past a series of stations to form toner images on an image surface. The image surface can be the peripheral surface 12. However, it is preferably a surface of a receiving sheet fed from a receiving sheet supply 18 and held to drum 10 as it is rotated. According to the latter embodiment, a receiving sheet is fed out of receiving sheet supply 18 and into contact with peripheral surface 12 where it is held by gripping fingers, vacuum or electrostatics. The surface of the receiving sheet facing away from drum 10 in this embodiment is the image surface. A uniform layer or layers of toner is applied to the image surface as it passes a toner applying means or station 42 which, as explained below, can be a magnetic brush toner applying device similar to that used for developing electrostatic images. Toner can be applied to the image surface without pretreatment of the surface, by appropriate choice of bias on station 42. Alternatively, the image surface can be uniformly charged by a corona charger 2 to assist in the toner applying function.

After a uniform layer of toner has been applied to the image surface, the toner applying station 42 is turned off, by means to be described. An imagewise tacking means, for example, a laser 5, is turned on and the toner is imagewise tacked to the image surface. Laser 5 can be a single, relatively high powered laser. Alternatively, a printhead comprised of a linear array of optical fibers powered by a series of laser diodes and constructed, as described in U.S. Pat. No. 5,164,742, issued Nov. 17, 1992, can be used to tack a plurality of lines of image at a single pass.

The toner is tacked to the image surface by sintering or softening the toner where it contacts the surface or softening the image surface itself or both. If the image surface is to be softened, it should be defined by an outer layer of a heat softenable thermoplastic. If the toner is to be sintered or softened, it must include a material that increases its tendency to adhere when heated, for example, a heat softenable thermoplastic. After the toner has been imagewise tacked to the image surface, it can be subjected to a neutralizing AC corona from a corona source 21 which makes the untacked toner easier to clean. Preferably, such an AC corona should have a small or no DC bias. The toner is then passed past a cleaning station 41 where the loose toner is cleaned from the image surface, leaving only the toner that had been tacked by laser 5. Cleaning station 41 can also be used to clean the image surface before toner is applied to it to improve the uniformity of laydown or application of the toner.

The receiving sheet is separated from drum 10 by a movable pawl 11 and fed to a fuser 13 where the toner image is fixed to the receiving sheet and ultimately deposited in an output tray 15.

The toner applying and cleaning processes are assisted by the location of a conductive material behind the image surface. If the image surface is on a paper receiving sheet, the paper itself can be made sufficiently conductive to provide this aspect and its location on a metallic drum can be used to connect the conductive paper to ground. However, if the receiving sheet is not conductive, for example, if it is a transparency, it is sometimes found advisable to coat a thin conductive layer on a nonconductive support underneath a heat softenable layer. This conductive layer is somewhat more difficult to connect to ground. As shown in FIG. 1, a pair of rollers 19 are positioned on opposite sides of drum 10 to contact such a conductive layer which has been left uncovered in the margins for this purpose. Two rollers 19 are used since the receiving sheet may not completely extend around peripheral surface 12. Two substantially separated rollers 19 assure continuity of contact. The conductive rollers 19 are articulatable so that they can be separated from the drum 10 if the drum 10 speed is substantially increased during the tacking portion of the process.

As mentioned above, it is possible to form toner images directly on surface 12 without interposing a receiving sheet. In this case the image surface is surface 12. After the loose toner is cleaned by cleaning station 41, the remaining lightly tacked toner image is transferred to a receiving sheet by a conventional electrostatic transfer station which must be strong enough to separate the lightly tacked toner from surface 12, which toner had not been cleaned by the cleaning station 41. Alternatively, heat assisted transfer can be used, in which the receiving surface is heated and pressure is applied sufficient to transfer the toner. An electrostatic field can be used to assit such a heat and pressure based transfer.

A third alternative is to include an imaging sheet upon which the image is formed, as described with respect to the first embodiment, and which is separated by pawl 11 but which, in turn, goes through a transfer step with a receiving sheet after separation from drum 10 to transfer the toner image from the intermediate to the final receiving sheet.

In conventional electrophotography, lasers are commonly used to expose photoconductors. They can be operated at the regular process speed of the rest of the stations of the machine. That approach can be utilized here, although it requires a substantially higher powered laser to tack toner than is required to expose a photoconductor. The actual approach shown in FIG. 1 involves operating both the toner applying steps and the toner cleaning steps at a relatively slow drum speed, comparable to an electrophotographic apparatus. The drum is rotated at a relatively fast speed for the tacking process with laser 5 being moved in a direction parallel to axis 9 of drum 10 to helically scan the image surface as the drum rotates once for each line of laser writing. Although the drum speed is increased substantially during exposing, the actual scan speed is much less than with a conventional optically deflected laser used in laser printers and similar apparatus. Thus, this approach brings more laser energy per pixel to the image surface, thereby permitting the use of a lower powered laser, albeit at the sacrifice of overall process speed. With this approach, speed is enhanced by using a linear array of laser diodes, as described above and in U.S. Pat. No. 5,164,742. Because of the power of laser 5, it may be desirable to vent the laser area by a suitable venting means 9 to remove any fumes created in the tacking process.

Figure 3:
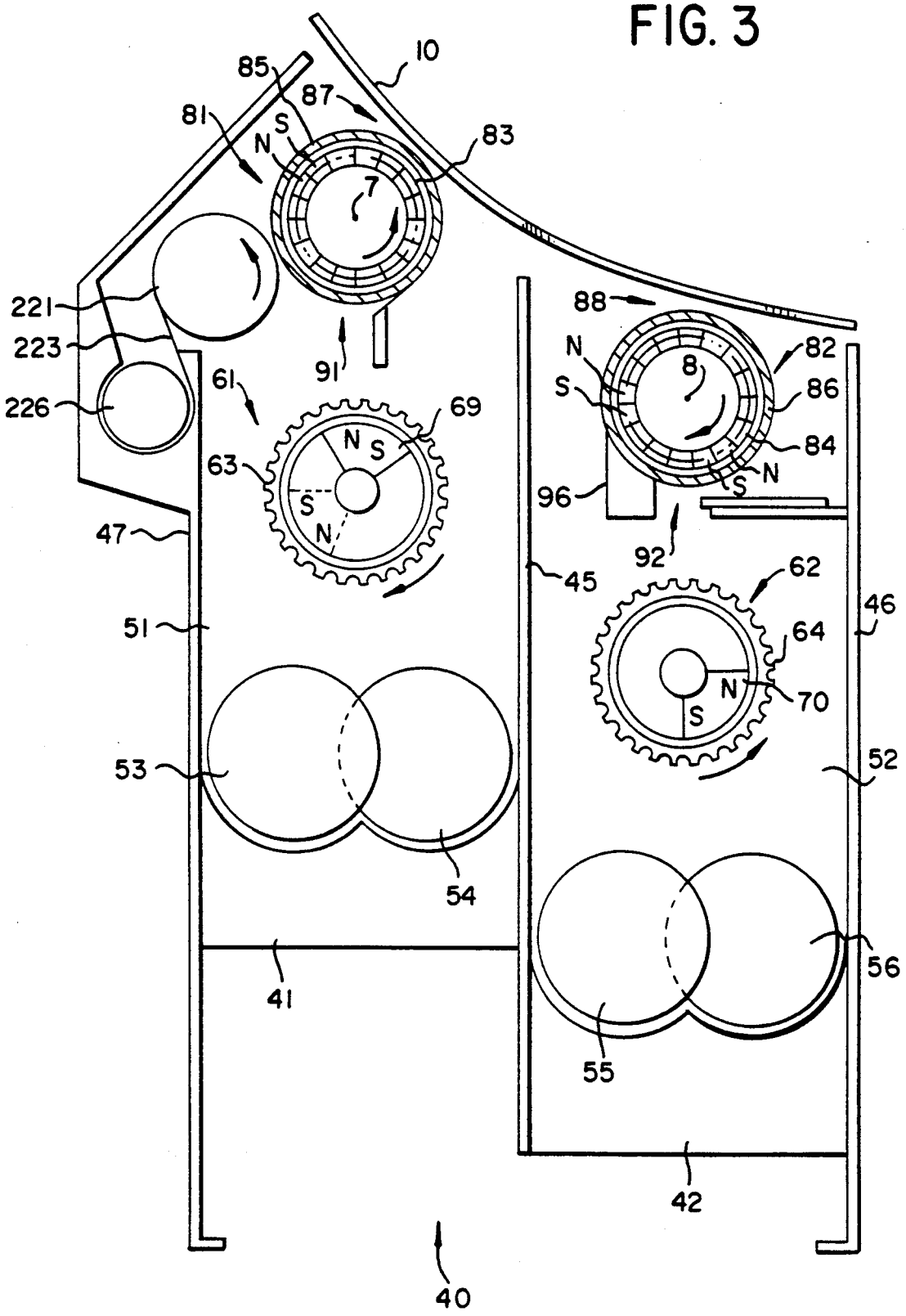
FIG. 3 is a front section, partially schematic illustrating toner applying and cleaning stations of the apparatus shown in FIG. 1.

Toning station 42 and cleaning station 41 are formed in a unitary module 40 and can be best described with respect to FIG. 3. According to FIG. 3, toner applying-cleaning unit 40 includes toner applying (sometimes called "toning") station 42 and cleaning station 41. Toning station 42 includes a sump 52 defined, in part, by a pair of sidewalls 46 and 45 and including mixing augers 55 and 56 located at its bottom. A toner transporting and valving device 62 is located above and spaced from mixing augers 55 and 56. It includes a fluted roller 64 which rotates generally in a counter-clockwise direction and a magnetic valve 70 which is rotatable between positions shown in hard line and in phantom in FIG. 3. At the top of toner applying station 42 is a toner applicator 82. Toner applicator 82 includes a rotatable magnetic core 84 having a series of north and south poles arranged around its circumference. A sleeve or shell 86 is positioned around core 84 and can be stationary or rotatable.

Sump 52 includes a supply of toner applying particulate material, commonly called "developer" made up of hard magnetic carrier particles having high coercivity and permanent magnetism and fine insulating toner particles. This developer is described more thoroughly in U.S. Pat. No. 4,546,060 to Miskinis and Jadwin, which patent is incorporated by reference herein.

In operation, fluted roller 64 and mixing augers 55 and 56 are rotated. Magnetic valve 70 is positioned in the position shown in bold lines in FIG. 3 to attract developer from sump 52 to fluted roller 64. Fluted roller 64 moves the developer to a position directly below applicator 82. The magnetic core 84, rotating about an axis of rotation 8, attracts developer through an opening 92 into contact with shell or sleeve 86. As core 84 is rotated, the hard, magnetized magnetic carrier particles are subjected to rapid pole transitions, causing them to flip on the surface of sleeve 86. This flipping action causes them to move around sleeve 86 in a direction opposite to that of core 84. Thus, if core 84 is rotated in a clockwise direction, as shown, developer will be moved in a counter-clockwise direction around sleeve 86. This movement can be aided by some movement of sleeve 86 itself or sleeve 86 can be stationary. The developer is moved through a toner applying position 88 in toner applying relationship with an image surface, which is preferably the outside surface of a receiving sheet carried by drum 10. Carrier depleted of toner continues on around sleeve 86 and is separated from sleeve 86 by a skive 96 and falls back into sump 52 to receive more toner. Toner is continually, periodically or on demand supplied to sump 52 to replace toner lost to the imaging surface.

Cleaning station 41 operates on a somewhat different principle. As with toner applying station 42, it includes mixing augers 53 and 54, a transporting and valving structure 61 and a cleaning element 81 similar to applicator 82. However, a cleaning station sump 51 holds particulate cleaning material made up primarily of hard magnetic carrier similar to or the same as the carrier used in the developer in sump 52 but, preferably, containing as little toner as possible. Sump 51 is defined, in part, by wall 47 and common wall 45 which separates the stations. Transport and valving structure 61 includes a fluted roller 63 and a rotatable magnetic valve 69 which are identical to transport and valving structure 62. Cleaning element 81 also includes a rotatable magnetic core 83 and a sleeve 85 which can be stationary or rotatable.

In operation, toner starved hard magnetic carrier is mixed by mixing augers 53 and 54 and supplied to fluted roller 63. If magnetic valve 69 is located in the position shown in phantom in FIG. 3, such carrier will be attracted to fluted roller 63 and delivered to an opening 91 where it is attracted by magnetic core 83 which is rotated about an axis of rotation 7. Rotatable magnetic core 83 is being rotated in a counter-clockwise direction which causes the toner starved particulate carrier to move around sleeve 85 in a clockwise direction, thereby bringing it through a cleaning position or zone 87 going in a direction opposite to that of the image surface. This particular type of magnetic brush has a very soft cleaning action because of the flipping and tumbling of the hard magnetic carrier. It gently cleans the toner which has not been tacked to the image surface off the image surface, leaving the toner image that was defined by the original tacking process.

The carrier, now saturated with cleaned toner, falls into sump 51 where it is mixed, reducing somewhat the toner concentration. As carrier approaches the cleaning position 87, it comes into contact with a detoning roller 221 which is shown rotated in the same direction as the movement of the carrier, i.e., counter-clockwise in FIG. 3. Detoning roller 221 is biased to create an electric field with respect to sleeve 85 that makes it attractive to toner. It, thus, removes toner from the carrier coming from sump and carries it on its surface. The detoning roller 221 contacts the cleaning particulate material while that material is under the influence of core 83. Thus, the magnetic particulate material does not have a tendency to stick to the surface of detoning roller 221. Toner on the surface of detoning roller 221 is scraped off that surface by a skive 223 and falls into an auger 226 which transports the toner to a collection bottle 301, shown in FIG. 2.

Figure 2:
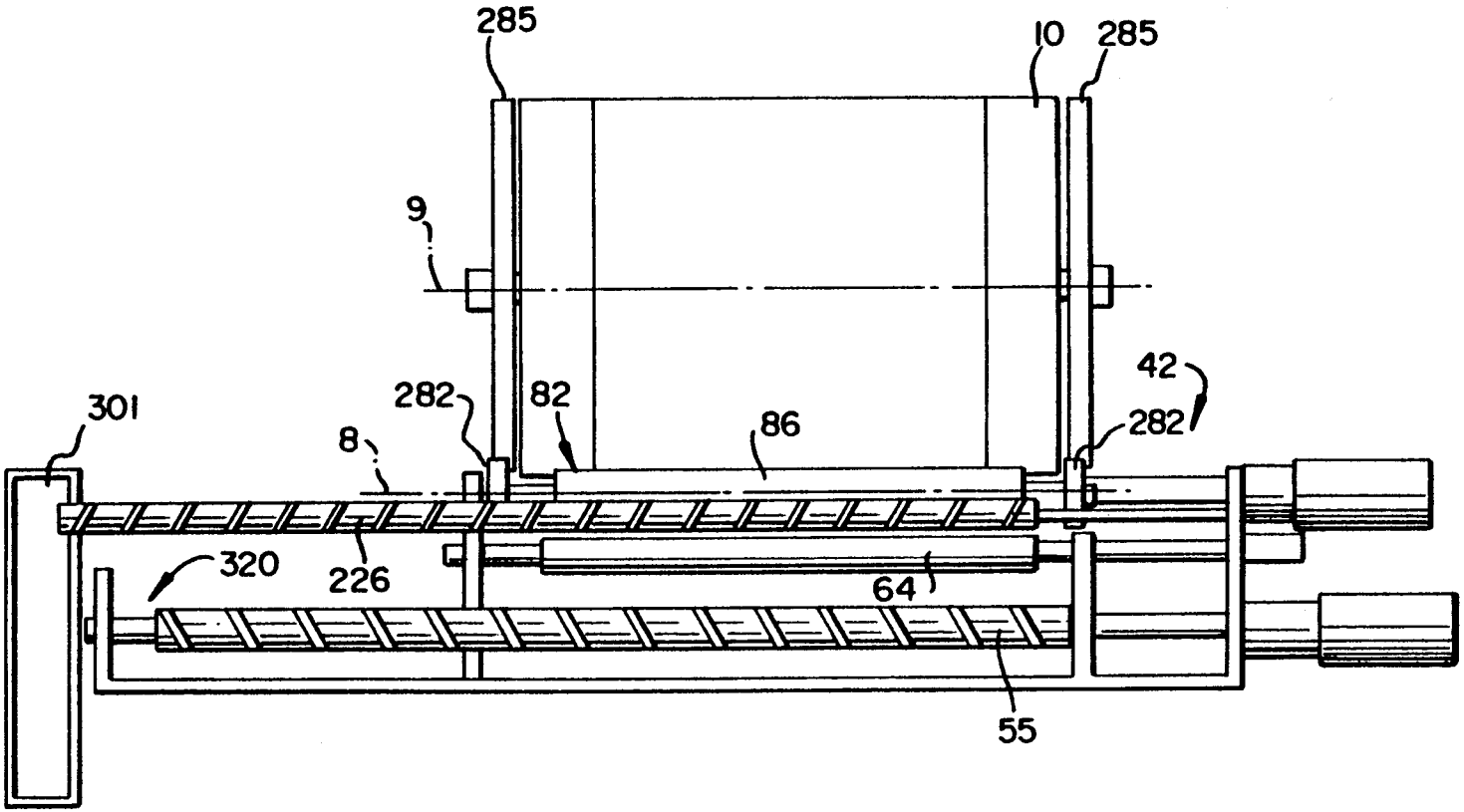
FIG. 2 is a side view of the apparatus shown in FIG. 1 with a portion of a cleaning station broken away and other elements eliminated for clarity of illustration.
Figure 4:
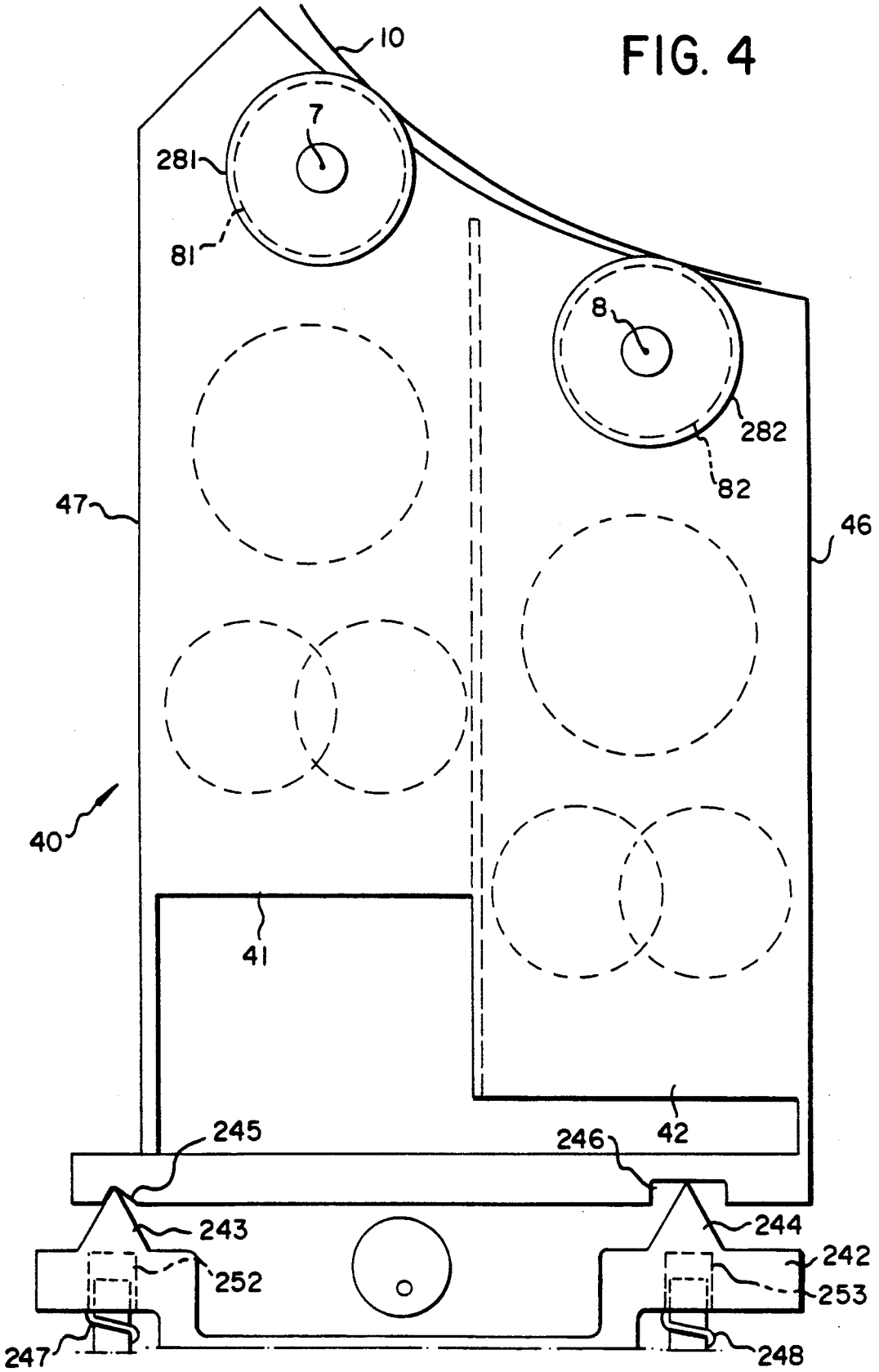
FIG. 4 is a front section illustrating a mount for the structure shown in FIG. 3.

FIGS. 2 and 4 show the mounting structure for unit 40 and illustrate one of the advantages of having both the toner applying and the toner cleaning stations in the same housing. As seen best in FIGS. 2 and 4, four spacing members 282 (FIGS. 2 and 4) and 281 (FIG. 4) are mounted about axes 8 and 7 of rotatable cores 84 and 83 (FIG. 3), respectively. As shown in the FIGS., the spacing members are disks which are sized to accurately space sleeves 85 and 86 from the image surface. Although disks 281 and 282 can engage peripheral surface 12 of drum 10, they may preferably engage separate cylindrical surfaces 285 positioned outside the ends of drum 10 and shown in FIG. 2. Cylindrical surfaces 285 have the same diameter as drum 10 and are mounted about the same axis 9 as is drum 10, but they do not rotate. Unit 40 is urged in a generally upward direction by springs 247 and 248 through a lift mechanism which includes mounting member 242 having recesses 252 and 253 and pointed protrusions 243 and 244. Pointed protrusions 243 and 244 engage recesses 245 and 246 which help define the lateral position of the unit 40. However, as springs 247 and 248 urge the unit 40 in a generally upward direction, the bottom of the unit 40 is free to move somewhat to allow the four disks 281 and 282 to all seat on the engaging surface of cylindrical members 285. If axes of rotation 7 and 8 are made parallel and disks 281 are the same size and disks 282 are the same size, this structure will automatically seat itself with axes of rotation 7 and 8 parallel to axis 9 of drum 10 and with sleeves 85 and 86 accurately spaced with respect to the image surface. For more details of this type of mounting structure, see U.S. Pat. No. 5,148,220, referred to above and hereby incorporated by reference herein.

When toner applying station 42 is being used to apply toner and the toner has not yet been tacked to the image surface, magnetic valve 69 in cleaning station 41 is moved to the position shown in bold lines in FIG. 3. In this position no particulate material is conveyed to opening 91 and no particulate material is moved to the cleaning zone 87. Thus, cleaning station 41 is not effective to clean despite the fact that it has not been moved away from the image surface. Similarly, after the toner has been applied to the image surface, magnetic valve 70 is moved to the position shown in phantom in FIG. 3 and no developer is moved to applicator 82. After the movement of the valve 70 to the nontransporting position, shown in phantom in FIG. 3, the magnetic core 84 is rotated a few turns to clean all developer still remaining on sleeve 82 out of the development zone 88 and no more toner is applied. When cleaning is to be begun, the magnetic valve 69 is returned to the position shown in phantom in FIG. 3 and cleaning can be carried out, as described above. Thus, with this system, the unit 40 can apply toner, it can clean toner or it can be totally inactive, for example, during tacking, without moving the unit 40 away from drum 10. This provides remarkable advantages over articulating the entire station in reliability and complexity. It also permits using the same housing for both stations. It provides one serviceable unit for both toner applying and cleaning.

Figure 5:
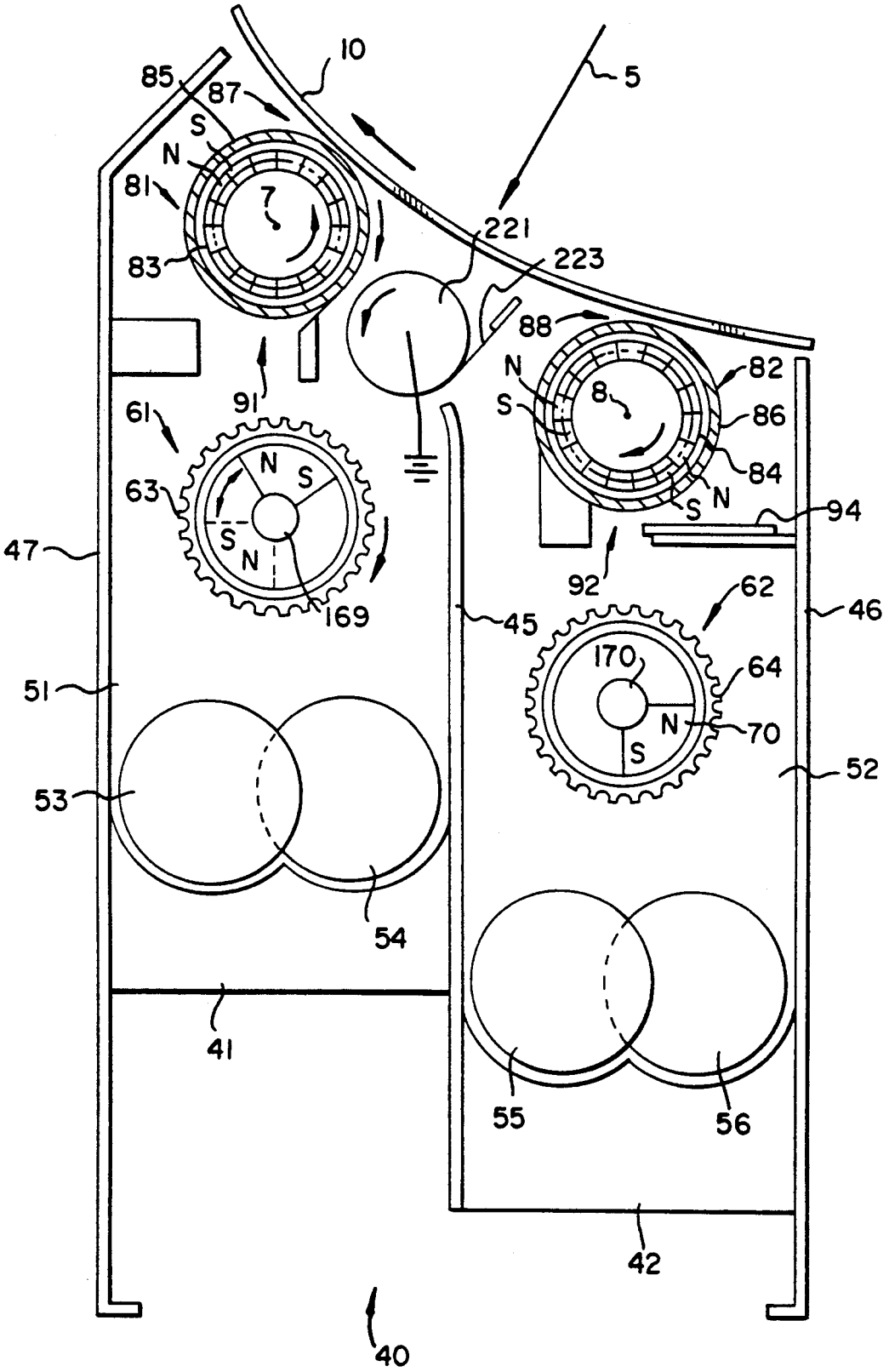
FIGS. 5–8 are front schematic sections similar to FIG. 3 illustrating different embodiments of toning applying and cleaning stations.
Figure 6:
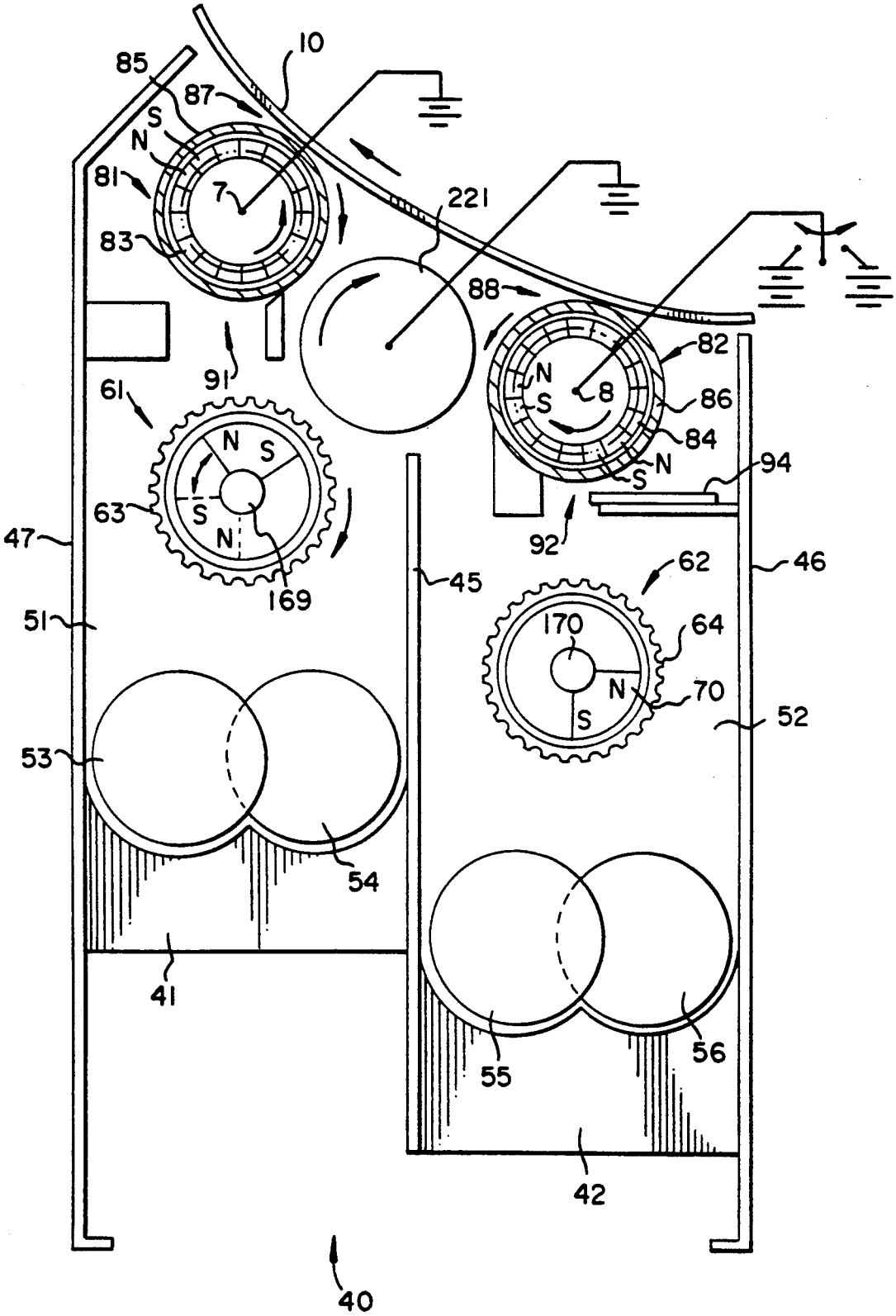

The image forming apparatus shown in FIG. 1 uses a large amount of toner. If the image is a line image, much of that toner is cleaned off by cleaning station 41. FIGS. 5 and 6 show embodiments of the FIG. 1 apparatus in which the toner is recycled back into the toner applying station 42. Although not limited thereto, this feature is greatly facilitated by having the stations in the same unitary module 40.

According to FIG. 5, toner removing or detoning roller 221 has a peripheral detoning surface that is positioned, as in FIG. 3, to remove toner from cleaning particulate material leaving cleaning zone 87. However, in FIG. 5, skive 223 is positioned to scrape toner off the detoning surface of roller 221 where it falls into toner applying station 42. Toner cleaned off roller 221 by skive or scraper 223 falls down into sump 52 where it is mixed again with carrier for reuse. This automatically recycles the toner with a minimum of complexity.

FIG. 6 shows an embodiment in which the skive 223 shown in FIGS. 3 and 5 embodiments is not necessary. In FIG. 6, detoning roller 221 is made large enough to engage both the particulate material leaving cleaning zone 87 and the material leaving zone 88. The material leaving zone 88 picks up the toner on roller 221, eliminating the need for a skive. This embodiment requires that station 42 be active during cleaning. Relative biases also become important. For example, with positive toner and negatively charged carrier, a bias of −150 V to −200 V on shell 86 attracts toner to it, removing some of the untacked toner. A bias from ground to −50 V on shell 85 attracts the rest of the untacked toner. A detoning roller 221 biased between −50 V and −150 V attracts toner from particulate material on shell 85 and gives it up to particulate material leaving zone 88 and falling into sump 52. The bias on shell 86 is changed to a positive bias during the toner applying step and cleaning station 41 is valved off. Note that cleaning by station 41 is effective, in part, because toner is removed from its particulate material, while cleaning by toner applying station is effective because of its bias adjustment.

New toner is added to development station 42 in all embodiments by a conventional mechanism, not shown, which periodically feeds toner onto an extension of mixing augers 55 and 56 in an extension 320 of station 42, shown in FIG. 2. Note that auger 226 (FIGS. 2 and 3) is extended substantially to transport cleaned toner to a toner collection bottle 301 located behind extension 320.

FIG. 5 illustrates still another embodiment of the invention. As seen in FIG. 5, laser 5 can optionally be located inside drum 10. In this embodiment, drum 10 is transparent and the support of the receiving sheet, if any, is sufficiently transparent to allow the radiation from laser 5 to tack toner after passing through drum 10 and the receiving sheet support. With such a structure, toner can be applied to the image surface by station 42, immediately tacked by laser 5 and then the loose toner immediately cleaned by station 41. This embodiment requires a laser or other concentrated power source to be powerful enough to tack the toner while being scanned across the full length of drum 10. It also requires a transparent receiving sheet. It, thus, may not be suitable for many applications and is described as an alternative to the original description of operation of FIG. 5 in which the laser 5 is positioned as it is in FIG. 1. Note also that this alternative embodiment of FIG. 5, has special application when toner is tacked directly to surface 12 and later transferred because it is not necessary in that embodiment to provide a transparent receiving sheet.

Figure 7:
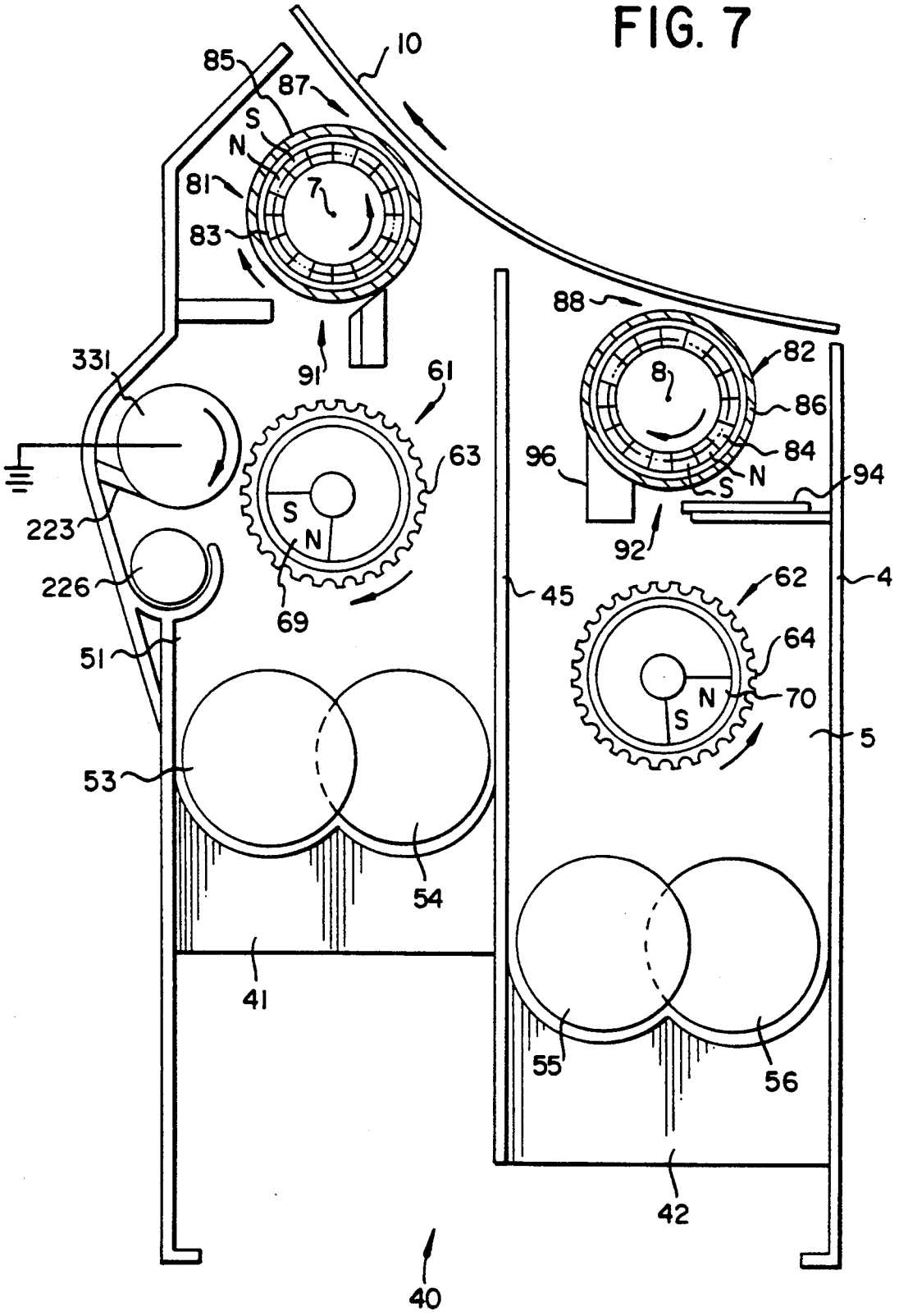
Figure 8:
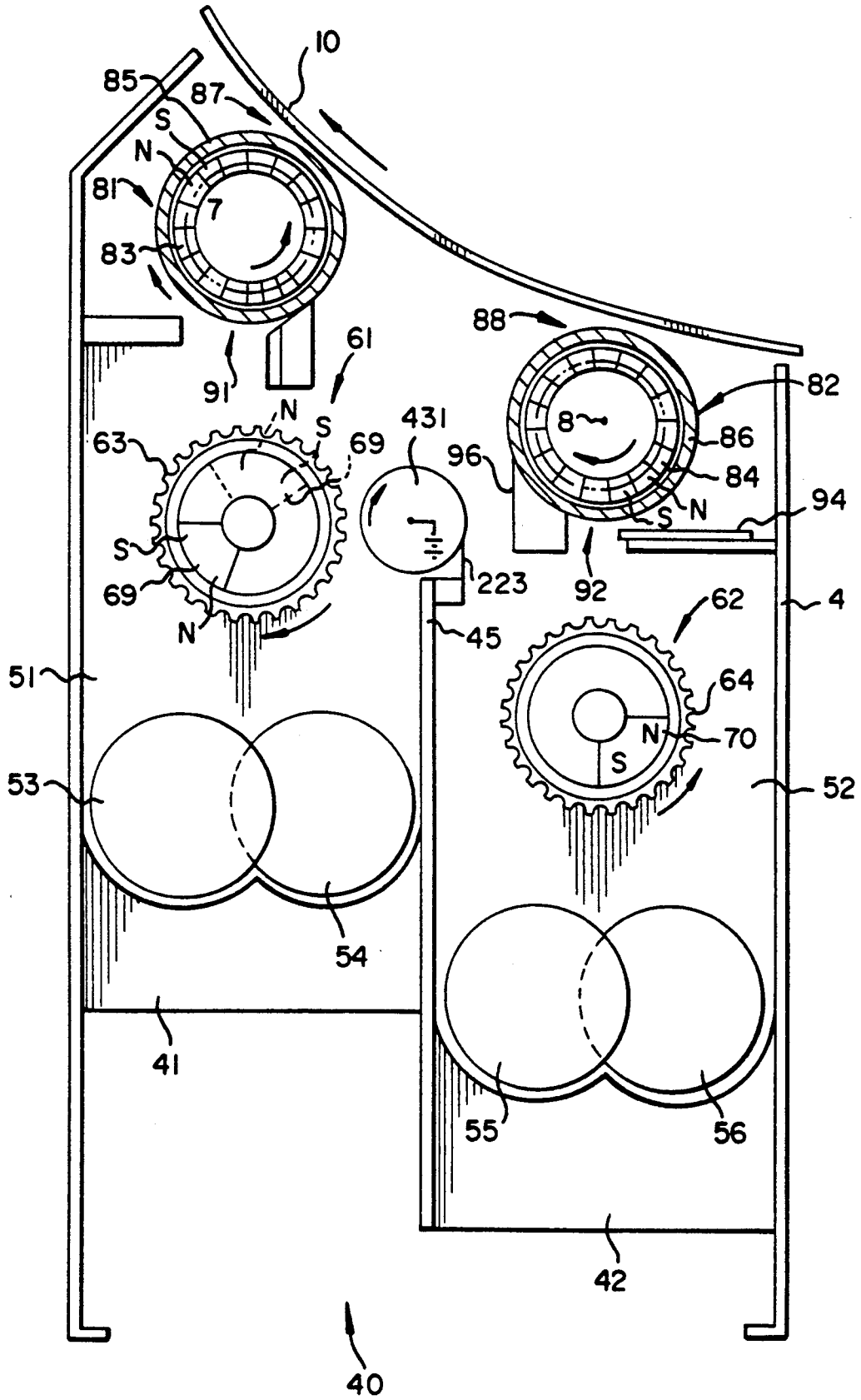

FIGS. 7 and 8 illustrate still different embodiments of the toning station originally shown in FIG. 3. According to FIG. 7, the unit 40 is constructed substantially the same as in FIG. 3, except that the detoning roller, in FIG. 7 identified as detoning roller 331, is positioned adjacent fluted transport roller 63 of transport 61. Detoning roller 331 removes toner from particulate cleaning material as it moves in the fluting on roller 63 toward cleaning element 81. Toner is skived by skive 223 off detoning roller 331 and into auger 226 which moves the cleaned toner to a toner collection bottle substantially as shown in FIGS. 2 and 3.

In operation, the cleaning station 41 in FIG. 7 cleans toner continuously by moving cleaning material in a clockwise direction around sleeve 85. The material falls back into sump 51 for mixing and then is retransported by fluted transport roller 63 to opening 91 to be used again. On its route back to cleaning element 81, the particulate material is detoned by detoning roller 331. This has similar detoning effect to that in FIG. 3. However, it has one important advantage over the FIG. 3 approach. When cleaning is finished and the apparatus is either applying toner or tacking or in between cycles, station 41 is put through a cycle as follows: first, transport 61 is stopped while core 83 is rotated for enough turns to remove all particulate material from sleeve 85 and return it to sump 51. At this point, core 83 is stopped and the transport 69 is begun again to move toner around transport 69 and back into sump 51. During this time, the particulate cleaning material is not moved to the cleaning position 87 because the core 83 is stopped. However, it continues to move past detoning roller 331 which is also turned on. Thus, with this system, the particulate material in sump 51 can be continually detoned even though the apparatus is in the toner applying or tacking portion of the image making cycle. This advantage is not available with the apparatus shown in FIGS. 3, 5 and 6, where the detoning roller operates adjacent cleaning shell 85.

FIG. 8 shows a modification of the approach shown in FIG. 7, except that the toner is recycled similar to the way it is recycled in the embodiment shown in FIG. 5. Referring to FIG. 8, detoning roller 431 is positioned on the right side of transport 61. In this position, it lies between the toner applying and cleaning stations 42 and 41. It detones particulate material falling from sleeve 85 toward sump 51 as that particulate material passes between transport 61 and detoning roller 431. When core 83 is not being rotated, it detones material being transported by fluted roller 63.

As detoning roller 431 is moved in a clockwise direction, it passes the falling particulate material moving downward and in an opposite direction in the detoning area. With cleaned toner on its surface, detoning roller 431 then rotates around into toner applying station 42 where skive 223 skives toner, which falls down into sump 52 for mixing and later applying to the image surface carried by drum 10.

The FIG. 8 embodiment, like the FIG. 7 embodiment, has the distinct advantage of allowing detoning by station 51 while the overall apparatus is in the tacking or toner applying portion of its cycle. Thus, extensive detoning can be accomplished prior to the next cleaning cycle. Note also, that the FIG. 8 embodiment has another advantage over the FIG. 7 embodiment in that, when core 83 is rotating, the particulate material is basically in a falling condition from sleeve 85 and is not really being transported by transport 61 during detoning. The magnetic valve 69 is not substantially attracting the particulate material to fluted roller 63 at any time during detoning. This allows more intimate contact between the particulate material and detoning roller 331 in the FIG. 8 embodiment than is normally possible in the FIG. 7 embodiment. It has the disadvantage that some cleaning material (carrier) may be transported as well. If it is the same as the carrier in station 42, this does not pose a substantial problem.

Although transport roller 63 is shown in both FIGS. 7 and 8 as fluted, the fluting can interfere with the detoning. It, thus, is preferable to make the fluting less deep in these embodiments. Alternatively, the fluted roller can be replaced by a roughened or finely serrated roller and magnetic gate 69 enlarged to extend further up the right side of roller 63.

The unit 40, in which a single housing includes both a toner applying station and a toner cleaning station, has particular utility in the toner tacking process described with respect to FIG. 1. However, it should be understood that it has application in other processes, including a conventional electrophotographic process. For example, two-cycle electrophotographic processes, known, per se, in which electrostatic image toning is accomplished on a first cycle of the apparatus and cleaning is accomplished on a second cycle, could utilize a unit constructed as described herein.

Present commercial utilizations of rotating core devices for developing electrostatic images include at least one in which the sleeve is not rotated and is not cylindrical in shape. For example, see U.S. Pat. No. 4,797,704 granted to Hill et al Jan. 10, 1989. In this design developer having a high coercivity, magnetized carrier is moved vertically up to a location close to the electrostatic image, as the electrostatic image approaches the development zone, and then the developer is moved through a path that includes an extended flat portion upstream of the position at which the core is closest to the image, but which path moves sharply away from the image downstream of that closest position. This path shape, defined by the shell, provides an extended development zone in which both the developer and the image are moving at the same speed and direction while the developer rapidly tumbles to continually present fresh toner to the image for development. It also moves the developer away from the image while it is under the strongest influence of the rotating core so that as little carrier as possible is picked up in the image.

FIGS. 9, 10 and 11 show a toner cleaning station in which the cleaning zone is extended in a rotating core magnetic brush cleaner similar to that shown in FIGS. 1–8 as station 41. Referring to FIG. 9, cleaning element 81, as in FIGS. 3–8, includes a rotating core 83 and a sleeve 85 that can be rotatable or stationary. Drum 10 moves the surface to be cleaned in a first direction from right to left, as shown in FIG. 9. For best cleaning, the particulate cleaning material is moved in a clockwise direction around sleeve 85 by rotating core 83 in a counter-clockwise direction so that the cleaning material is moving in a second direction generally opposite to the surface to be cleaned in the cleaning zone 87. To extend the cleaning zone so that more toner can be attracted to the particulate cleaning material, the shell is extended in the second direction, along the surface to be cleaned by an addition 191, which can be a permanent part of a stationary shell 85 or can be a stationary protrusion underneath which the shell 85 rotates in a clockwise direction. Obviously, if the shell 85 is stationary, the protrusion 191 can be formed integrally with it, much as the shell is shown in U.S. Pat. No. 5,083,166 referred to above, which patent is hereby incorporated by reference in this application.

Note that with this construction, the extension of the cleaning zone 87 is done upstream (in the second direction) with respect to the movement of the surface to be cleaned by drum 10, as in the prior art. However, the extension is downstream as to the direction of movement of the developer which, in this instance, is moving in a direction opposite to that of drum 10 and the image surface to be cleaned. Because of this, there is little danger of pickup of particulate cleaning material by that surface. That is, as the drum 10 moves downstream of the cleaning position, the particulate cleaning material closest to it is held strongly by core 83 to shell 85 as the particulate material moves in a direction opposite that of the drum 10. This structure, thus, offers the advantage of less cleaning material pickup than do toner applying structures of the same general construction. Experiments with this design indicate substantially improved cleaning efficiency without substantial pickup of particulate cleaning material by the image surface.

FIGS. 10 and 11 show alternative shapes for this portion of the shell. FIG. 10 illustrates a lengthy cleaning zone in which a curved extended surface is extended on both sides of the position that the core 83 is closest to drum 10. This structure, when compared to that of FIG. 9, has the advantage of doubling the cleaning zone. However, it has the disadvantage of not protecting as well as the FIG. 9 structure does against the pickup of particulate carrier by the image surface. With the cleaning material moving opposite to the image surface, this is of less concern than in a toning application.

FIG. 11 illustrates a structure extremely close to that shown in FIG. 9, except that an extension 193 has a top portion 194 that is curved to more clearly parallel the surface to be cleaned which is being driven by drum 10. The FIG. 10 extension 196 also has a curved top surface that is generally parallel to the surface to be cleaned. Again, in the FIG. 10 embodiment, while this provides an evenly spaced cleaning zone, it also causes the particulate cleaning material to be less closely held by the magnetic core at the left end of the cleaning zone as the surface to be cleaned leaves the zone. Thus, although cleaning may be more efficient, the pickup of particulate cleaning material must be dealt with.

Extremely high quality versions of the apparatus shown in FIG. 1 are feasible even though a relatively small number of images are made in a given length of time. Thus, it may be feasible in the cycle of operation to move the entire surface to be cleaned past the cleaning station more than once. The FIG. 9 structure does such an efficient job of cleaning that, for many applications, a single pass through the system provides an excellent fixable image on the surface being cleaned. Note also that the surface being cleaned is the final image surface and small amounts of carrier that are picked up end up in the fused image. This does not cause nearly the bad visible effect noticed in conventional electrostatic imaging when a single carrier particle can prevent transfer for a much larger area around it. That benefit of this system, of course, would not be available in the embodiment in which the image is made directly on the surface 12 of drum 10 and the image is later transferred to a receiving sheet.

It is also known in the electrostatic image development art to strategically locate a magnetic shunt around a portion of a rotating magnetic core to improve development. See, for example, U.S. Pat. No. 4,638,759 granted to Ville et al. According to FIG. 12, a cleaning station is shown which is constructed substantially as is cleaning station 41 in FIG. 3, except that a ferromagnetic shunt 209 is positioned on the inside of shell 85. Shell 85 can be stationary, in which case the shunt 209 is fixed to the inside of the shell 85. The shell can also be movable in the same direction as the movement of the developer (clockwise in FIG. 12). In this case, the shunt is a separate piece which is separately mounted between the shell and the core with both the shell and the core moving with respect to it. In either instance, the shunt 209 is stationary and is positioned from the position closest to drum 10, downstream with respect to movement of the particulate material and upstream with respect to movement of the image surface carried on drum 10. The shunt is positioned approximately around one-fourth or 90° of the shell and includes the cleaning zone 87. The figure of 90° for shunt size is determined by the concentration of the poles. The shunt must be large enough to bridge two adjacent poles. Thus, for an eight-pole core, 90° is a workable size.

The shunt is positioned to greatly increase carrier agitation while, at the same time, reducing any chain length of the carrier nap. The transition points, where carrier goes from the region outside the shunt to the region of the shunt, and vice-versa, are the areas of interest. One of these zones must fall within the toner removal zone for the shunt to be efficient. This provides increased agitation which increases the effectiveness of the removing process, particularly useful in this application. It is quite difficult to remove untacked toner without also removing some of the tacked toner. The gentleness of the rotating core brush system has greatly improved this process in the first place by providing a gentle removing brush. The ferromagnetic shunt, shown in FIG. 12, makes the cleaning action still more efficient. That efficiency does not appear to substantially reduce gentleness.

For highest quality images, even if some toner is remaining on the image with one pass past the shell shown in FIG. 1, second or third passes can be used to complete the removing process while still using an extremely gentle brush.

Figure 12:
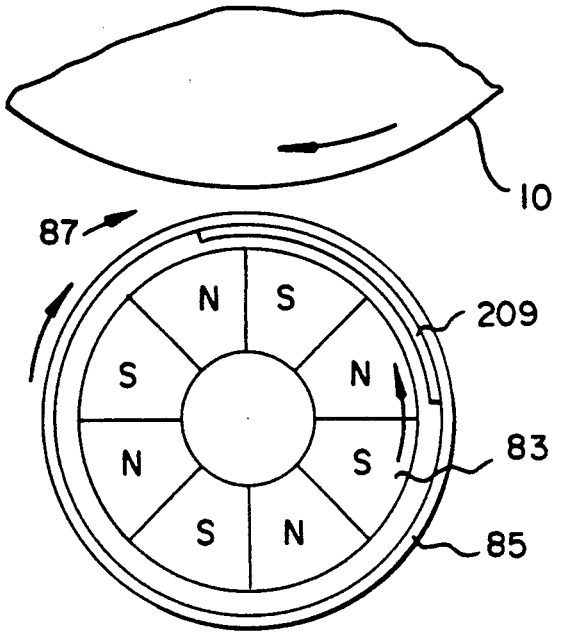
Figure 13:
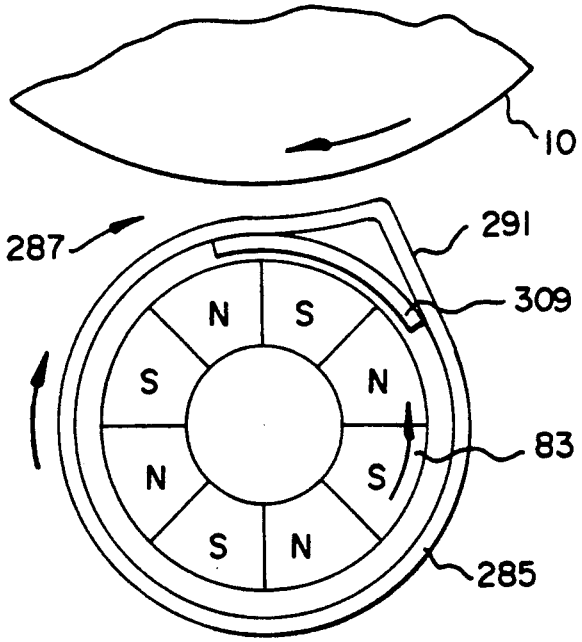

According to FIG. 13, a combination of the features shown in FIGS. 9, 11 and 12 is illustrated. In FIG. 13 shell 285 is stationary and is noncylindrical for at least a portion 291 which is extended upstream with respect to the movement of drum 10 similar to the structure shown in FIG. 11. In addition to the extended removal zone 287, that removal zone is shunted by shunt 309 which extends entirely across the removal zone. The structure shown in FIG. 13 provides both an extended removal zone and increased carrier agitation but with short chain length in the carrier nap. The combination is an extended but very gentle cleaning brush. Again, the extension provided by portion 291 increases the overall efficiency of the brush while the shunt 309 makes the brush more gentle. Whether the extension increases the efficiency enough to provide complete cleaning in a single pass depends on the nature of the materials and the application of the system. For highest quality images, it may still be desirable to move the image surface through the cleaning process twice.

Since, for highest quality imaging, there is occasionally a desire to move the image surface through the cleaning station twice, another variation on the FIG. 3 embodiment can be used. That is, both stations 41 and 42, shown in FIG. 3, can be cleaning stations providing double cleaning in a single pass with the stations mounted with the advantages obtained from the two-station unitary design. In this instance, two detoning rollers, one for each station, can feed cleaned developer into a single auger for removal or for feeding to a toner applying station otherwise mounted.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus having a device for cleaning toner off a surface, which device comprises:

a sump containing particulate cleaning material, means for moving particulate cleaning material along a first path from the sump through a cleaning position where it passes through cleaning relation with the surface to be cleaned and then back to the sump, means for moving particulate material along a second path from the sump to a position away from the sump and back to the sump without passing through the cleaning position, and detoning means positioned in detoning relation with the particulate cleaning material in the second path.

2. Apparatus according to claim 1 wherein the first and second paths have a common portion and said detoning means is adjacent the common portion.

3. A device for cleaning toner off a surface to be cleaned, said device comprising:

a sump containing particulate cleaning material, a cleaning element positioned to move particulate material through a cleaning position in cleaning relation with the surface to be cleaned, a particulate material transport for moving particulate material from the sump to the cleaning element, and a detoning roller positioned in detoning relation with particulate material associated with the particulate material transport, said cleaning device having a first mode in which cleaning material is moved by said particulate material transport from the sump to the cleaning element and by said cleaning element through the cleaning position and a second mode in which the material is moved by the particulate material transport away from the sump, past the detoning roller and then back to the sump but is not moved by the cleaning element through the cleaning position.

4. A cleaning device according to claim 3 wherein the detoning roller is positioned in detoning relation with particulate material being moved by said particulate material transport in both the first and second modes.

5. Image forming apparatus comprising:

means for applying toner to an image surface, means for imagewise tacking toner to said surface, means for cleaning untacked toner from said surface, the means for cleaning untacked toner from the surface including, a sump for containing a supply of particulate cleaning material, a cleaning element for moving particulate cleaning material through cleaning relation with the image surface, means for transporting particulate cleaning material from the sump to the cleaning element, and a detoning roller positioned in detoning relation with particulate material associated with the transporting means, and wherein said cleaning means has a cycle of operation in which said cleaning element is turned off during at least one of the toner applying and imagewise tacking functions of the apparatus, but both the detoning and transporting means of the cleaning device function to detone particulate material while the cleaning element is off.

* * * * *